US006223754B1

(12) United States Patent
Burdi et al.

(10) Patent No.: US 6,223,754 B1
(45) Date of Patent: May 1, 2001

(54) MULTI-FOLD COSMETIC COMPACT

(75) Inventors: Joseph H. Burdi, Staten Island, NY (US); Dennis J. Preteroti, Hewitt, NJ (US)

(73) Assignee: Jerhel Plastics Inc, Bayonne, NJ (US)

( * ) Notice: Subject to any disclaimer, the term of this patent is extended or adjusted under 35 U.S.C. 154(b) by 0 days.

(21) Appl. No.: 09/531,645

(22) Filed: Mar. 21, 2000

(51) Int. Cl.[7] ..... A45D 33/24
(52) U.S. Cl. ..... 132/300; 132/295; 206/823
(58) Field of Search ..... 132/300, 315, 132/293, 295, 294, 296; 206/581, 823; 220/DIG. 26

(56) References Cited

U.S. PATENT DOCUMENTS 1,456,450 * 5/1923 Kendall ..... 132/295
3,256,892 * 6/1966 Esposito, Jr. ..... 132/300
5,232,001 * 8/1993 Machelett ..... 132/293
5,842,486 * 12/1998 Davis et al. ..... 132/295

* cited by examiner

*Primary Examiner*—John J. Wilson
*Assistant Examiner*—Melba Bumgarner

(57) ABSTRACT

A single individually molded plastic unit comprises a base member having two opposite side edges with a flat bottom surface and an open top surface having a raised continuous periphery. A cover member has the same shape and two side edges as the base member, and also has a top surface and an open bottom surface having a raised continuous periphery. One side edge of the cover member is secured to one side edge of the base member by a living hinge. A catch is detachably engageable with the bottom surface of the cover member and is supported by an external projection secured to the opposite side edge of the base member. Inward movement of the projection toward the base member releases the catch engagement and allows the cover member to be pivoted about the living hinge away from the base member.

3 Claims, 4 Drawing Sheets

MULTI-FOLD COSMETIC COMPACT

BACKGROUND OF THE INVENTION

Cosmetic compacts containing facial powers, creams and the like are conventionally assembled from a plurality of individual components each of which is separately manufactured. The present invention is directed toward a new type of component utilizing plastic material wherein all components are formed and interconnected by a single molding process thus forming a cosmetic compact at a cost which is a mere fraction of the cost of cosmetic compacts utilizing assembled components separately manufactured.

SUMMARY OF THE INVENTION

In accordance with the principles of this invention as applied to a first embodiment, the compact utilizes, in a single individually molded unit, a base member having a flat bottom surface and an open top surface with a raised continuous periphery. This base member has two oppositely disposed side edges. The unit also utilizes a cover member of like shape and size and also having two oppositely disposed side edges. The cover member has a top surface and an open bottom surface with a raised continuous periphery. One side edge of the cover member is secured to one side edge of the base member by a living hinge. A catch detachably engageable with the bottom surface of the cover member is supported on an external projection secured to the opposite side edge of said base member. The two members can be folded together using the living hinge to close the compact.

Inward movement of the projection toward the base member releases the catch engagement and allows the cover member to be pivoted about the living hinge away from the base member, thereby opening the compact.

In another embodiment of the invention, the compact utilizes in a single individually molded unit, the same base member having a flat bottom surface and an open top surface with a raised continuous periphery and the same cover member having a top surface and an open bottom surface with a raised continuous periphery. However, the compact also utilizes a platform member of like shape but of somewhat smaller size. The platform member has two oppositely disposed side edges and has a contoured bottom surface and a recessed top surface.

One side edge of the cover member is secured to one side of the base member by a first living hinge. One side edge of the platform member is secured to the opposite side of the base member by a second living hinge. The platform member can be pivoted about the second hinge and snap fitted into the base member with the contoured bottom surface of the platform member engaging the open top surface of the base member. The cover member can then be pivoted about the first hinge until its raised periphery of its open bottom surface engages the raised periphery of the top surface of the base member, thus enclosing the platform member between the base and cover members and closing the compact.

The one side edge of the platform member can have a catch detachably engageable with the bottom surface of the cover member. The second living hinge can have an external projection supporting the catch whereby inward movement of the projection toward the platform member releases the catch and the cover member can be pivoted away from the platform member to open the compact.

While it is an essential feature of the invention that the various members each have two oppositely disposed side edges, the members can otherwise assume the shape of any polygon having at least four sides.

Additional objects and advantages of this invention will either be explained or will become apparent hereinafter.

DETAILED DESCRIPTION OF PREFERRED EMBODIMENTS

Figure 1:
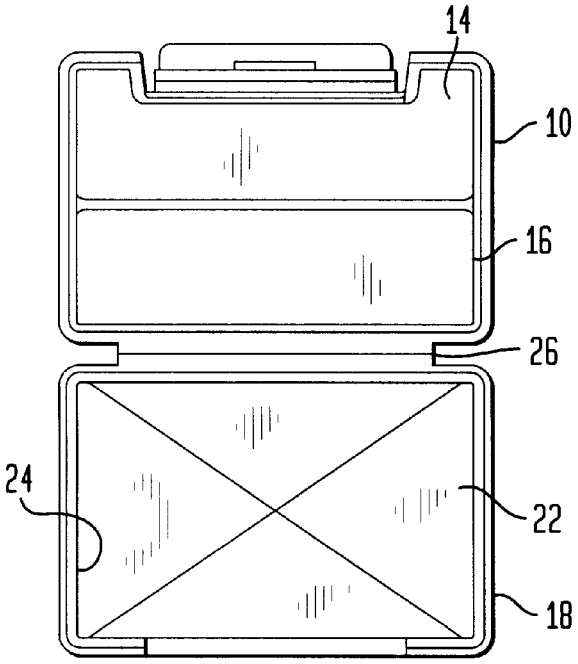
FIG. 1 is a top plan view of a single mold unit in accordance with a first preferred embodiment of the invention.
Figure 2:
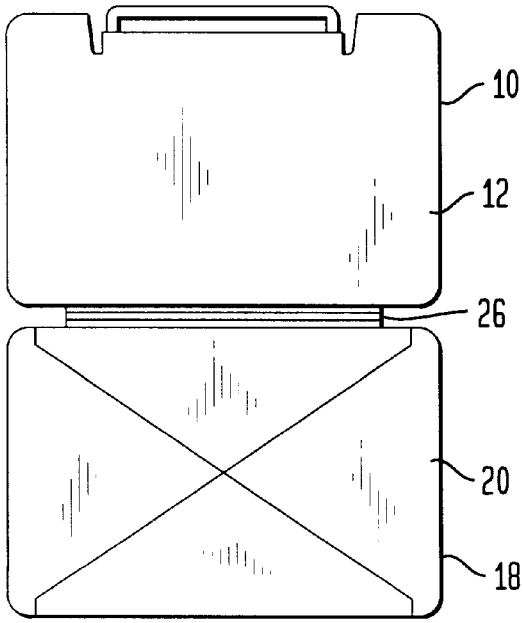
FIG. 2 is a bottom plan view of the unit of FIG. 1.
Figure 3:
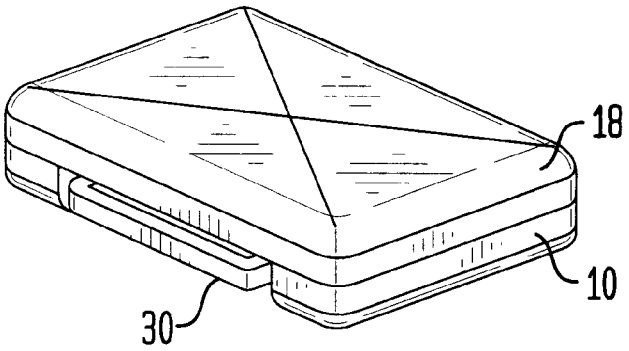
FIG. 3 is a perspective view of a cosmetic compact in closed position utilizing the unit of FIGS. 1 and 2.
Figure 4:
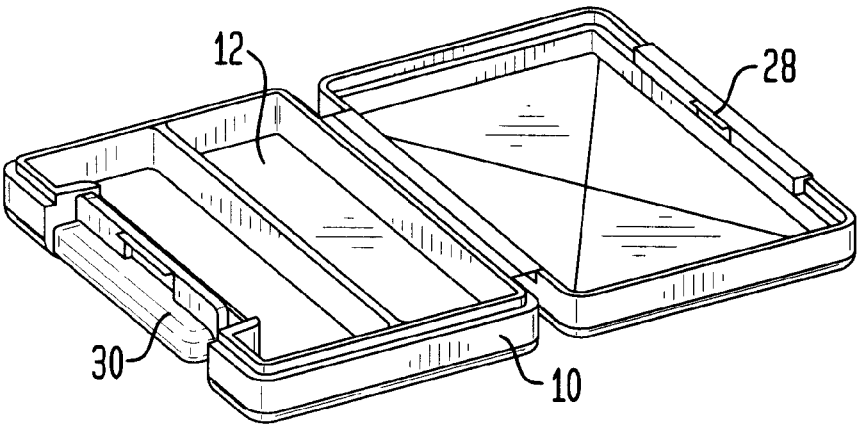
FIG. 4 is a view of the same cosmetic compact of FIG. 3 in open position.

Referring first to FIGS. 1–4, a cosmetic compact defining a single individually molded plastic unit comprises a base member 10 having the shape of a polygon having at least four sides. The base member has two opposite side edges with a flat bottom surface 12 and an open top surface 14 having a raised continuous periphery 16.

A cover member 18 has the same shape and two side edges as the base member, and also has a flat top surface 20 and an open bottom surface 22 having a raised continuous periphery 24. One side edge of the cover member is secured to one side edge of the base member by a living hinge 26.

A catch 28 is detachably engageable with the bottom surface of the cover member and supported by an external projection or button 30 secured to the opposite side edge of said base member whereby inward movement of the button toward the base member releases the catch engagement and allows the cover member to be pivoted about the living hinge away from the base member.

Figure 5:
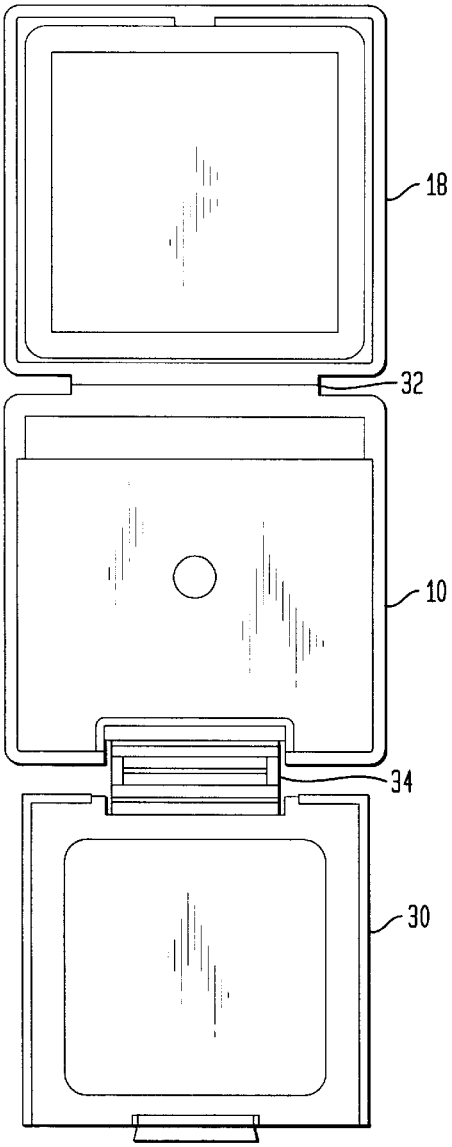
FIG. 5 is a top plan view of a single mold unit in accordance with a second preferred embodiment of the invention.
Figure 6:
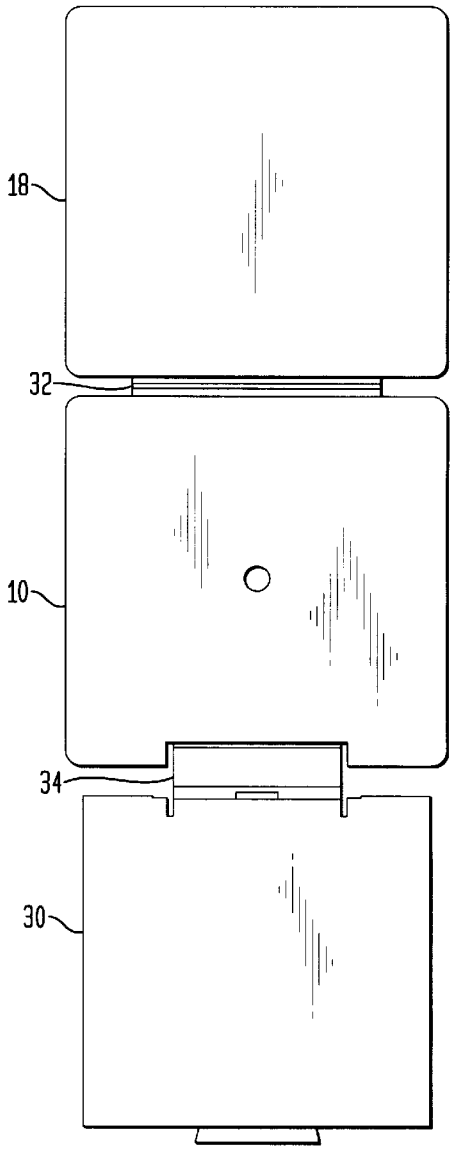
FIG. 6 is a bottom plan view of the unit of FIG. 5.
Figure 7:
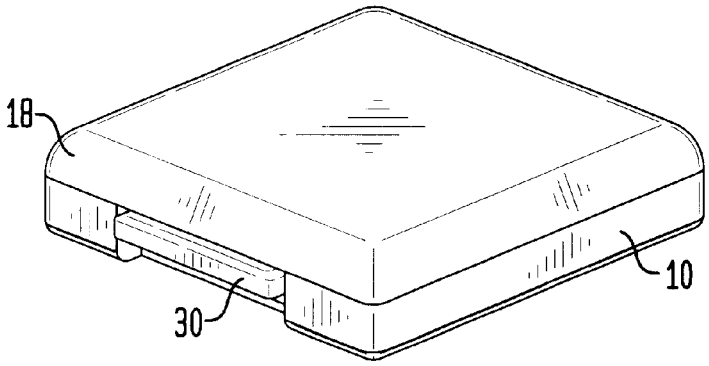
FIG. 7 is a perspective view of a cosmetic compact in closed position utilizing the unit of FIGS. 5 and 6.
Figure 8:
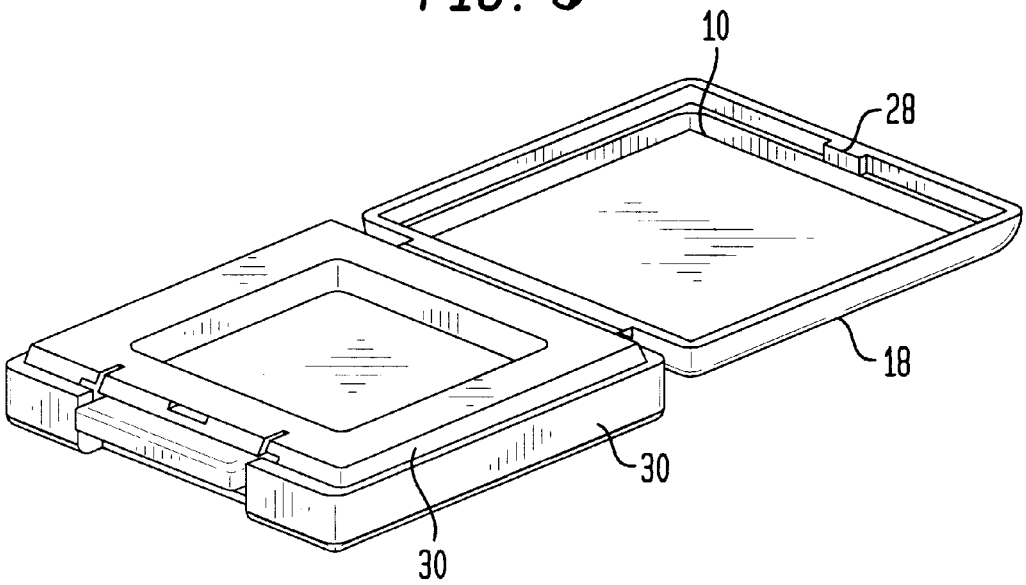
FIG. 8 is a view of the same cosmetic compact of FIG. 7 in open position.

Referring now to FIGS. 5–8, In another embodiment of the invention, the compact utilizes in a single individually molded unit, the same base member 10 having a flat bottom surface and an open top surface with a raised continuous periphery and the same cover member 18 having a flat top surface and an open bottom surface with a raised continuous periphery. However, the compact also utilizes a platform member 31 of like shape but of somewhat smaller size. The platform member has two oppositely disposed side edges and has a contoured bottom surface and a recessed top surface. One side edge of the cover member is secured to one side of the base member by a first living hinge 32. One side edge of the platform member is secured to the opposite side of the base member by a second living hinge 34.

The platform member can be pivoted about the second hinge and snap fitted into the base member with the contoured bottom surface of the platform member engaging the open top surface of the base member.

The cover member can then be pivoted about the first hinge until its raised periphery of its open bottom surface engages the raised periphery of the top surface of the base member, thus enclosing the platform member between the base and cover members and closing the compact.

The one side edge of the platform member can have a catch detachably engageable with the bottom surface of the cover member. The second living hinge can have an external projection supporting the catch whereby inward movement of the projection toward the platform member releases the catch and the cover member can be pivoted away from the platform member to open the compact.

In all of the compacts illustrated, a cosmetic product may be placed in the base member and a mirror 40 may be placed in the bottom surface of the cover member.

While the invention has been described with particular reference to the drawings and detailed description, the protection solicited is to be limited only by the terms of the claims which follow.

What is claimed is:

1. A cosmetic compact defining a single individually molded plastic unit, said unit comprising:

a base member having two oppositely disposed side edges extending between a closed bottom surface and an open top surface with a raised continuous periphery;

a cover member having the same shape and size and two oppositely disposed side edges as the base member, the cover member having a closed top surface and an open bottom surface having a raised continuous periphery;

a platform member having two oppositely disposed side edges and having the same shape as the other two members but being slightly smaller in size, the platform member having a contoured bottom surface and a recessed top surface;

one side edge of the base member being secured to one side edge of the cover member by a first living hinge;

an opposite side edge of said base member being secured to an adjacent side edge of the platform member by a second living hinge;

said platform member being pivotable about said second hinge and the opposite side edge of the platform member to snap fit in recessed position within the base member with the contoured bottom surface of the platform member engaging the open top surface of said base member; and said cover member being pivotable about said first hinge until the periphery of its bottom surface engages the periphery of the top surface of the base member to close the compact with the platform member being recessed within the base member.

2. The unit of claim 1 wherein all members have the shape of a polygon having at least four sides.

3. The unit of claim 2 wherein the bottom surface of the cover member has rectangular mirror means secured thereto.

* * * * *